US009903676B2

(12) United States Patent
Calvete et al.

(10) Patent No.: US 9,903,676 B2
(45) Date of Patent: Feb. 27, 2018

(54) AMMUNITION SYSTEM AND AMMUNITION FOR FIREARMS

(71) Applicant: Ardesa, S.A., Zamudio-Vizcaya (ES)

(72) Inventors: Angel Calvete, Zamudio-Vizcaya (ES); Thomas F. Hall, Higganum, CT (US)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 15/227,582

(22) Filed: Aug. 3, 2016

(65) Prior Publication Data

US 2017/0038171 A1 Feb. 9, 2017

Related U.S. Application Data

(60) Provisional application No. 62/202,401, filed on Aug. 7, 2015.

(51) Int. Cl.

| | |
|---|---|
| ***F41C 9/08*** | (2006.01) |
| ***F41A 9/37*** | (2006.01) |
| ***F42B 14/06*** | (2006.01) |
| ***F42B 5/073*** | (2006.01) |

(52) U.S. Cl.

CPC ..... *F41A 9/375* (2013.01); *F41C 9/08* (2013.01); *F42B 5/073* (2013.01); *F42B 14/064* (2013.01); *F42B 14/067* (2013.01)

(58) Field of Classification Search

None

See application file for complete search history.

(56) References Cited

U.S. PATENT DOCUMENTS

| | | | | |
|---|---|---|---|---|
| 4,232,468 | A | 11/1980 | Chapin | |
| 7,726,245 | B2 | 6/2010 | Quesenberry et al. | |
| 2005/0183318 | A1 | 8/2005 | McGivern | |
| 2014/0090284 | A1* | 4/2014 | Peterson | F42B 5/38 42/51 |

* cited by examiner

*Primary Examiner* — Stephen Johnson

(74) *Attorney, Agent, or Firm* — Robert Curcio; DeLio, Peterson & Curcio, LLC

(57) ABSTRACT

An ammunition system and associated ammunition for firearms, particularly for muzzleloader firearms, having a predetermined amount of propellant charge housed in a casing, and a separate projectile having a sabot. The casing has a cap sealing the casing muzzle end such that the cap and the sabot provide seals to trap propellant gases within the barrel behind the projectile upon firing. The cap top end and sabot bottom end interlock in mechanical communication with one another upon firing allowing the projectile exiting the barrel muzzle end to be responsive to the barrel rifling. The barrel breech end has a chamber bushing for receiving the casing and a tapered muzzle end to prohibit the projectile from entering the casing.

10 Claims, 9 Drawing Sheets

AMMUNITION SYSTEM AND AMMUNITION FOR FIREARMS

This application claims domestic priority from U.S. provisional application 62/202,401, filed on Aug. 7, 2015.

BACKGROUND OF THE INVENTION

1. Field of the Invention

This invention relates generally to an ammunition system for firearms, and more particularly to an ammunition system for muzzleloader firearms, which allows the ammunition to have a predetermined amount of propellant charge encased in a housing along with a separate muzzleloader projectile that when combined with the encased propellant charge, presents an ammunition cartridge that is significantly different than the prior art.

2. Description of Related Art

Like most early firearms, the first rifles were muzzleloading firearms. A muzzleloader is any firearm into which the projectile and usually the propellant charge is loaded from the muzzle of the gun (i.e., from the forward, open end of the gun's barrel). This is distinct from the more popular modern designs of breech-loading firearms. There are generally three types of muzzleloading firearms: inline 209 primers and percussion, caplock, and flintlock muzzleloaders. Inline 209 primers and percussion muzzleloaders tend to look like most modern firearms. The inline and caplock muzzleloaders differ on where the nipple is attached. In an inline muzzleloader, the cap is in line with the hammer and the barrel. The inline has the nipple attached to the barrel at the breech and accessed by a bolt or break action. Also, the inline model has a removable breech plug, to facilitate cleaning. Caplock rifles have a side-mounted firing pin similar to the flintlock rifle, and operate and load in much the same way, but uses a more modern pre-loaded firing cap to fire the rifle. A flintlock style of muzzleloader dates back to the 17th century and features a flintlock mechanism that produces sparks when a piece of flint strikes its steel frizzen.

Loading a traditional black powder muzzleloader firearm generally involves a certain amount of complexity (as compared to the loading of modern firearms). For loose, granular powder such general steps include: a) making sure the rifle is not primed; b) making sure the rifle bore is clean of fouling and oil; c) setting a powder measure for a desired powder charge; d) pouring the powder into the measure and then into the muzzle of the rifle; and e) using a ramrod, pressing the bullet, such as a patched round ball, past the rifling and down the bore until it contacts the powder charge.

The ammunition used in muzzle loaded rifles has evolved from a projectile that is a round ball compressed in the muzzle end with a patch, to projectiles that have incorporated features of modern bullets. Within the latter category, bullet shaped projectiles can be further subdivided into those that are fired with a sabot (which replaces the patch), and projectiles that are lubricated slugs. A sabot is an encasing plastic cup that generally falls away from the projectile after it exits the gun. The sabot eliminates the need for a lubricating means and assures that there is a good seal between the projectile and the bore of the barrel.

Current muzzle loading ammunition comprises multiple parts that are combined together when loaded into a firearm. Because the various parts are separate, they are not sealed, and they use pyrotechnic materials such as black powder or black powder substitutes that tend to be hygroscopic (they tend to absorb moisture from their surroundings and in particular absorb water vapor from the atmosphere). As a result, their efficiency degrades overtime, and the propellant and resultant combustion products tend to corrode the firearm barrel and chamber.

A complete round of ammunition consists of all the components necessary for one firing of the gun. These normally include a projectile, the propellant or busting charge, and a primer that ignites the propellant. Other components such as cartridge case and fuse are also included.

For muzzleloading firearms, multiple ammunition components are loaded from the open end of the barrel. These multiple components include at least a propellant charge and projectile. The propellant charges comprise a predetermined amount of black powder, black powder substitutes, or smokeless gunpowder. The projectile typically comprises a bullet and a sabot. In some instances, the projectile and the propellant charge are inserted into the barrel as a unitary structure. Alternatively, the propellant charge is loaded separately from the projectile. In such instances, the propellant charge is loaded first into the barrel, followed by the sabot and the bullet.

Ammunition has evolved over the years, but some general terminology has remained constant, and the terms are used herein in their accepted fashion:

1. a cartridge, is a single unit of ammunition; for a modern small arms cartridge this is the combination of a bullet, propellant, primer and cartridge case in a single unit. The cartridge case is generally cylindrical in shape and includes an internal lumen. A propellant is contained within the lumen of the cartridge case. Ignition of the propellant provides the energy that propels the saboted bullet at a target;
2. a "round" is a term synonymous with a fully loaded cartridge containing a projectile, propellant, primer and casing; and
3. a "fixed round" is a round of ammunition which when stored outside of the firearm chamber prior to loading the round, has the propellant and the bullet commonly engaged to each other by direct engagement.

Loading or charging propellants into muzzleloading guns has long presented problems. The propellant, either black powder or a substitute thereof, is normally handled in granular form (grains), with each charge being determined by measuring out a selected weight or volume of the propellant from a bulk supply, delivering it to the bore of the gun, placing a projectile in the bore, and seating the charge by ramrod into the breech. The charging of this propellant thus requires special tools and implements which must be carried to the field of use and kept readily available for re-loading. In addition, there is always the risk of improper measurement and spillage of loose powder. Other problems exist. It is difficult to obtain uniform powder compaction from load to load. It is difficult to re-load with speed and accuracy, and the use of smokeless powder, if not properly measured, could pose an additional risk.

Various forms of ammunition have been proposed for muzzle loading ammunition. Such ammunition over the years evolved from round ball projectiles to ammunition that has incorporated many of the features of modern bullets. For example, U.S. Pat. No. 7,726,245 issued on Jun. 1, 2010, titled "MUZZLELOADER AMMUNITION," teaches a fixed round of ammunition for a muzzleloader firearm. The round has a bullet within a sabot that is engaged to a consumable cartridge case. The case is filled with propellant. The bullet is engaged to the propellant composition via the cartridge case. This "fixed round" attempts to incorporate fully modern bullet attributes. In contrast, the more typical muzzle loading ammunition comprises multiple parts which are combined together when loaded into a firearm.

SUMMARY OF THE INVENTION

Bearing in mind the problems and deficiencies of the prior art, it is therefore an object of the present invention to provide a case used to hold the propellant charge, and protect the charge from moisture absorption.

It is another object of the present invention to provide a bullet that is separate from the propellant charge case, but interacts with the charge case after ignition to have the combination be responsive to the rifling.

The above and other objects, which will be apparent to those skilled in the art, are achieved in the present invention which is directed to an ammunition for a firearm having a barrel with a breech end and a muzzle end, the ammunition comprising: a projectile; a casing having a forward end and a back end, the casing including: a cap at the forward end for sealing a propellant charge within the casing; a rim at the back end in mechanical communication with the firearm barrel breech end when the casing is inserted within the barrel; and a primer situated at the casing back end and responsive to a firing pin; wherein the projectile and the casing are separate components independently loaded into the firearm.

The projectile is loaded into the barrel muzzle end, and the casing is loaded into the barrel breech end.

The ammunition may include a sabot slidably attached to the projectile, such that the cap and the sabot provide seals to trap propellant gases behind the projectile.

The sabot includes a bottom end having at least one indentation or extension, and the cap having a top end adjacent the sabot bottom end when the projectile and the casing are inserted in the barrel, respectively, the cap top end including at least one complementary extension or indentation for insertably receiving the sabot bottom end. The at least one indentation or extension on the sabot bottom end, and the at least one complementary extension or indentation on the cap top end, comprise designed imprints formed in the sabot and the cap respectively.

The propellant charge may include a predetermined amount of black powder, smokeless powder, Pyrodex™, Triple Se7En™, American Pioneer™, and other synthetic replacements.

In a second aspect, the present invention is directed to a muzzleloading firearm ammunition system including: a barrel of the muzzleloading firearm having a breech end and a muzzle end, the barrel breech end modified to receive ammunition; ammunition comprising a projectile portion and a charge portion, the projectile portion including: a projectile; and a sabot attached to the projectile; the charge portion including: a casing having a top end, a bottom end, and a hollow body, the hollow body containing a predetermined amount of propellant charge; a cap mounted to the casing top end, the cap sealing the propellant charge from environmental elements; the casing bottom end having a rim in mechanical communication with the barrel breech end when the casing is inserted within the barrel breech end, and a primer situated at the casing bottom end and responsive to a firing pin.

The barrel breech end may include a chamber bushing having a breech end and a muzzle end and wherein: the chamber bushing breech end includes an accessible inner diameter for receiving the casing of predetermined outer diameter, and the chamber bushing muzzle end having an inner diameter smaller than the projectile diameter or the sabot diameter, such that it is not possible to load the projectile from the barrel breech end, or insert the projectile into the chamber bushing from the chamber bushing muzzle end.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10 of the drawings in which like numerals refer to like features of the invention.

Ammunition for firearms is introduced that allows a user to safely load a predetermined encased propellant charge in the firearm, and in the example of a muzzleloading firearm, compress a projectile to the encased propellant charge to form a round of ammunition within the firearm chamber. Although ammunition of the present invention is capable of use in a number of different types of firearms, in a preferred embodiment the ammunition is suited for muzzleloading firearms, and examples of use and applicability are best described in reference to muzzleloading firearms without limitation to other types of firearms.

Figure 1A:
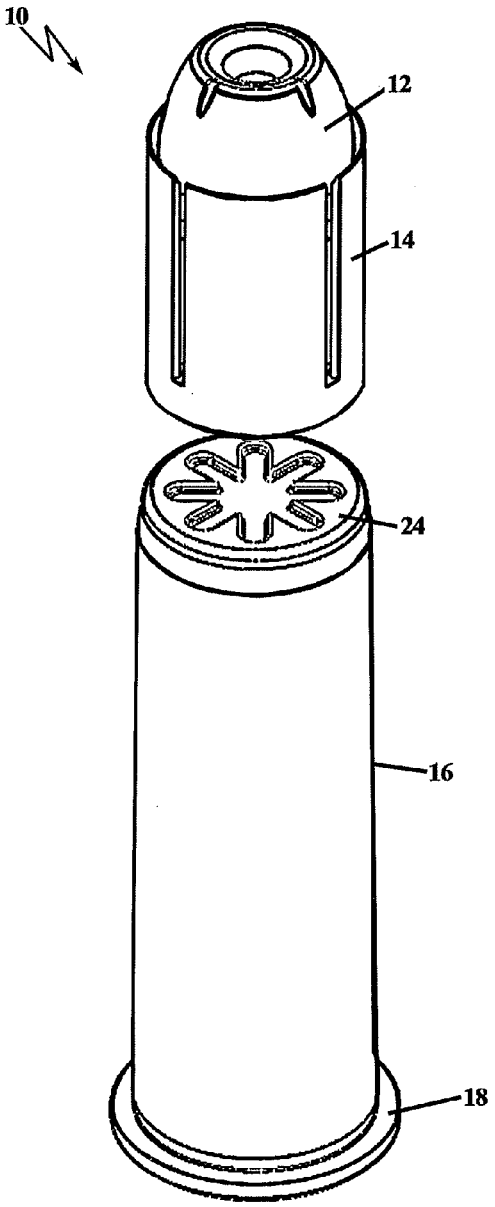
FIG. 1A depicts one embodiment of the ammunition of the present invention.

As depicted in FIG. 1A, ammunition 10 includes a projectile 12, such as a cone-tipped cylindrical "bullet", that is separate and distinct from a casing 16. Projectile 12 is preferably encased in a sabot 14 to ensure a sealed placement of the projectile within the barrel when the projectile is inserted within the firearm, and in the case of muzzle-loading firearms, inserted from the muzzle end of the firearm by a ramrod. Casing 16 is inserted from the breech end of the firearm into the barrel up to rim 18. The sabot ensures the correct positioning of the projectile (bullet or shell) in the barrel of the firearm. The sabot is generally attached either to the projectile or inside the barrel and falls away as it leaves the muzzle. The sabot ensures that a strong seal traps propellant gases behind the projectile, and keeps the projectile centered in the barrel, thus filling the undesirable but necessary gap between the projectile and barrel, which is the space referred to as the windage. Firing a small size projectile wrapped in a sabot raises the muzzle velocity of the projectile.

Casing 16 is filled with propellant charge or power load. Casing 16 includes a cylindrical body and a rim 18 that may be formed integrally with the cylindrical body. Rim 18 secures a primer 20 which is designed to receive the force of the firing pin when the firearm trigger is activated. After charged propellant 22 is loaded within the cylindrical body of casing 16, cap 24 is attached to the end of casing 16 opposite rim 18, which seals the charged propellant from the external environment. Cap 24 is preferably designed of the same characteristics as sabot 14; essentially of the same material, although the two components may be designed of compatible materials which are not necessarily the same. As will be discussed in further detail herein, the top of cap 24 is designed to communicate mechanically, such as by interlocking, with the bottom of sabot 14. This mechanical communication will ensure that projectile 12 is fully engaged by sabot 14, such that projectile 12 will rotate with sabot 14 when the tandem combination is subjected to rifling in the barrel as it projects outwards upon its flight.

Figure 1B:
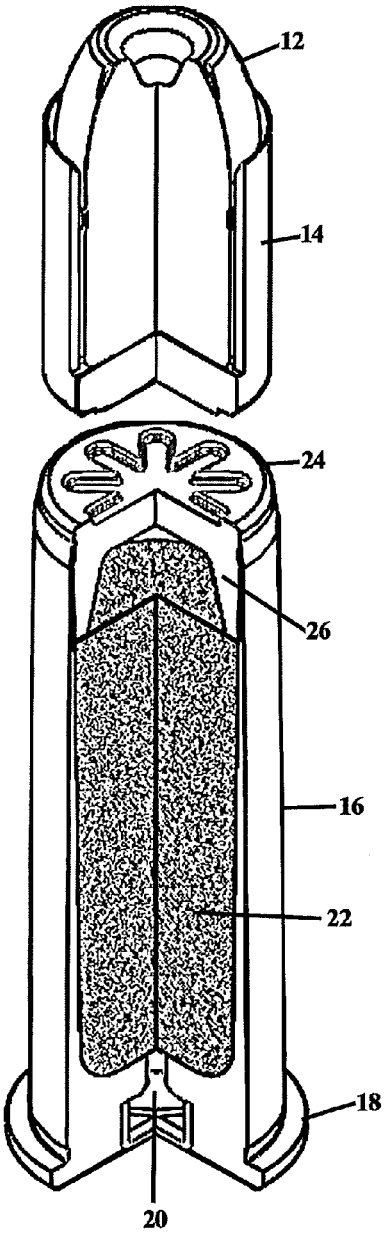
FIG. 1B is an exploded, partial cross-sectional view of the ammunition of FIG. 1A.

FIG. 1B is an exploded, partial cross-sectional view of the ammunition 10 of FIG. 1A. As shown, propellant charge 22 is loaded within casing 16 and sealed therein by cap 24 at one end, and rim 18 at the other end. In one embodiment, cap 24 preferably includes a cylindrical cup portion 26 for insertion within the top end of casing 16. Cup portion 26 seals propellant charge 22 within casing 16, providing protection for the propellant charge from outside environmental elements.

Figure 2:
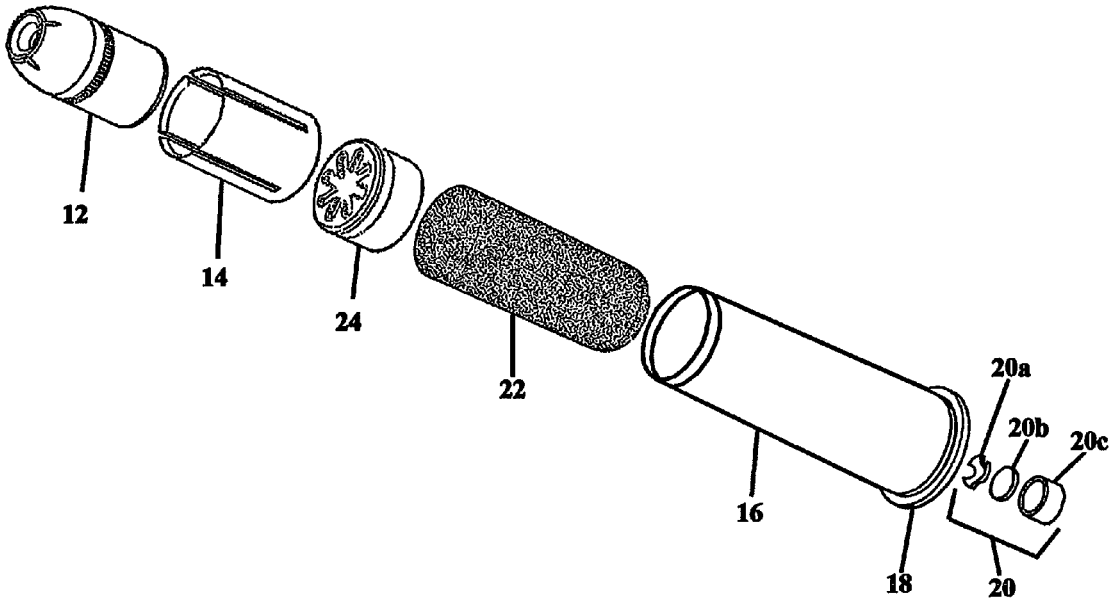
FIG. 2 depicts an exploded view of the ammunition of FIG. 1A.

FIG. 2 depicts an exploded view of ammunition 10. In this figure, the primer components 20*a,b,c* that are insertable within rim 18 of casing 16 are also shown.

Figure 3:
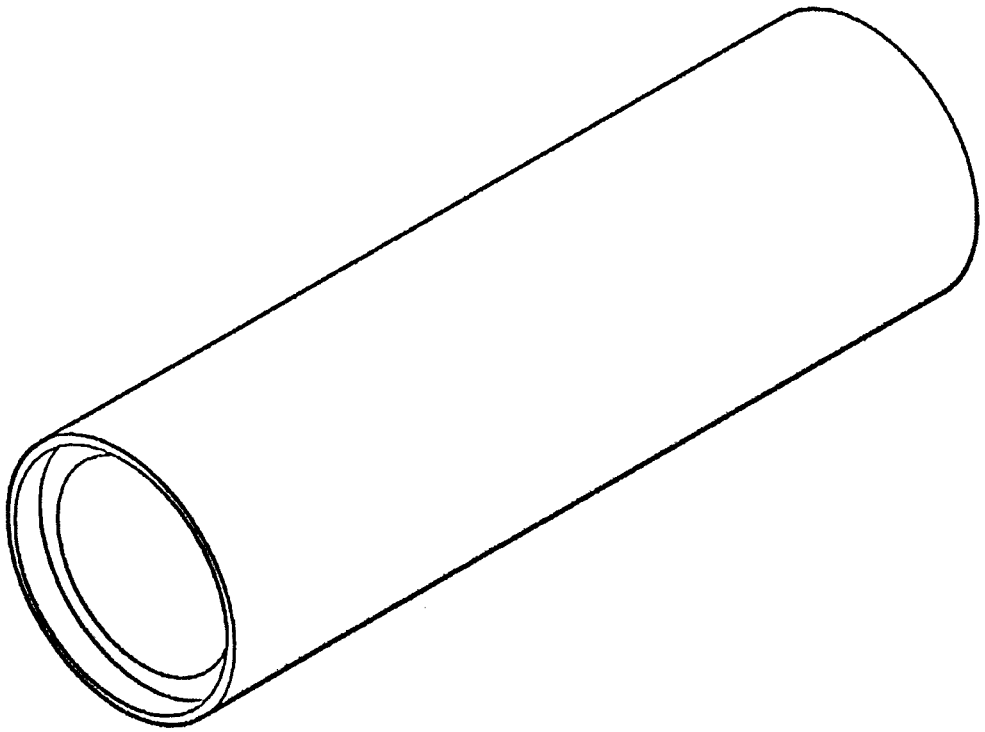
FIG. 3 depicts a chamber bushing for insertion within the barrel of a firearm for receiving the casing of the ammunition FIG. 1A.

FIG. 3 depicts a chamber bushing 30 for insertion within the barrel of the firearm. Chamber bushing 30 is a reducing bushing that reduces the inner diameter of the breech end of the barrel that receives casing 16.

Figure 4:
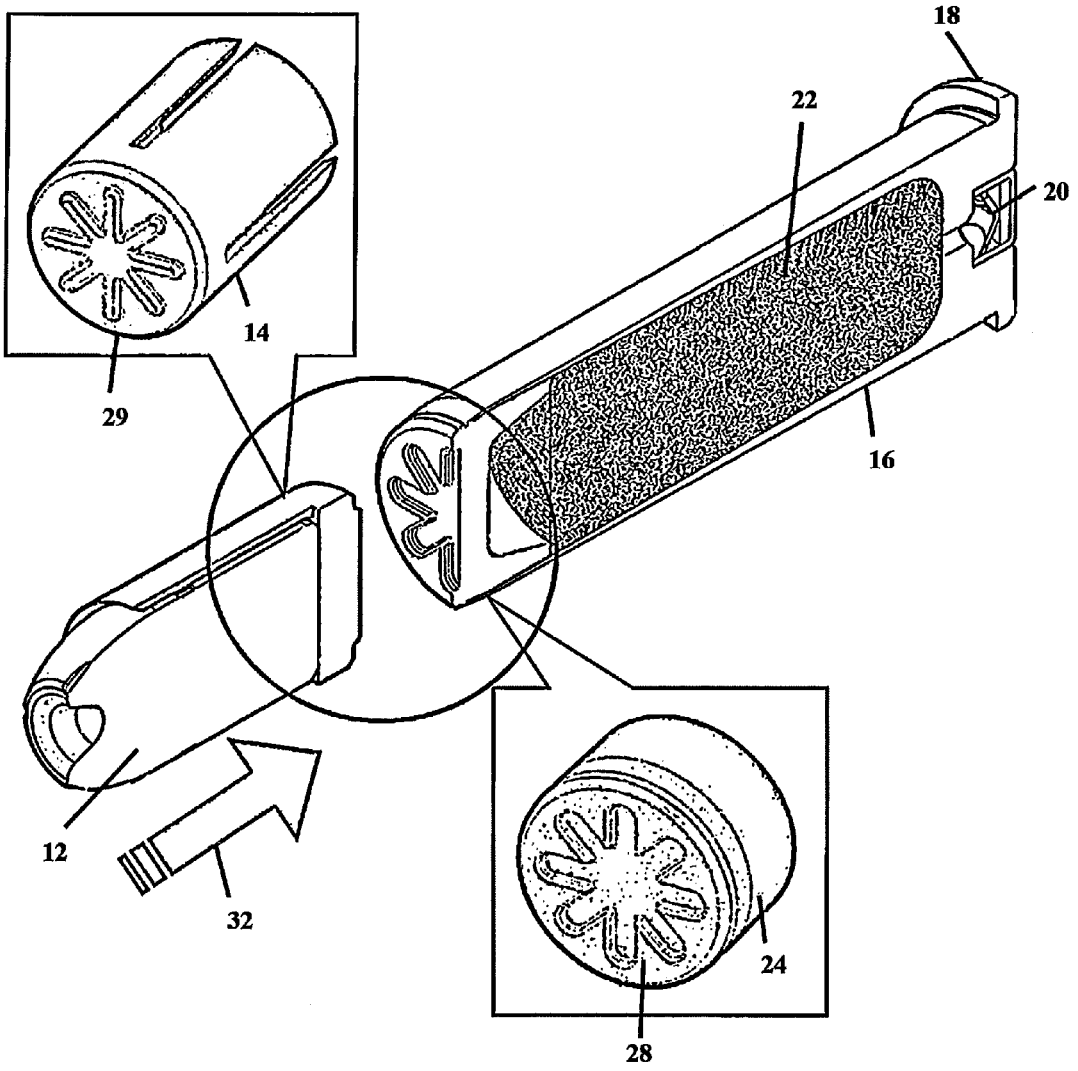
FIG. 4 depicts a "rotational transmission system" formed by the combination of a sabot on the projectile of the ammunition of FIG. 1A, and cap on the casing of the ammunition of FIG. 1A.

FIG. 4 depicts a "rotational transmission system" formed by the combination of sabot 14 and cap 24. Cap 24 has at least one indentation 28 on its top face or peripheral edge which is received by a mating complementary extension 29 on the exposed bottom of sabot 14. Alternatively, the indentation on cap 24 may instead be an extension extending from the face or edge and a mating complementary indentation may be formed on sabot 14. As depicted in FIG. 4, indentation 28 may be a star pattern having radially extended spokes, and extension 29 on sabot 14 may be a similar complementary pattern for interlocking with indentation 28 during firing. The rotational movement between sabot 14 and cap 24 is achieved inside the barrel when the firearm is fired and the ammunition is exiting the barrel, thereby allowing the rifling on the barrel's interior surface to rotate the cap/sabot combination. Arrow 32 depicts the direction of compression of projectile 12 by a ramrod from the muzzle end of the barrel.

Figure 5:
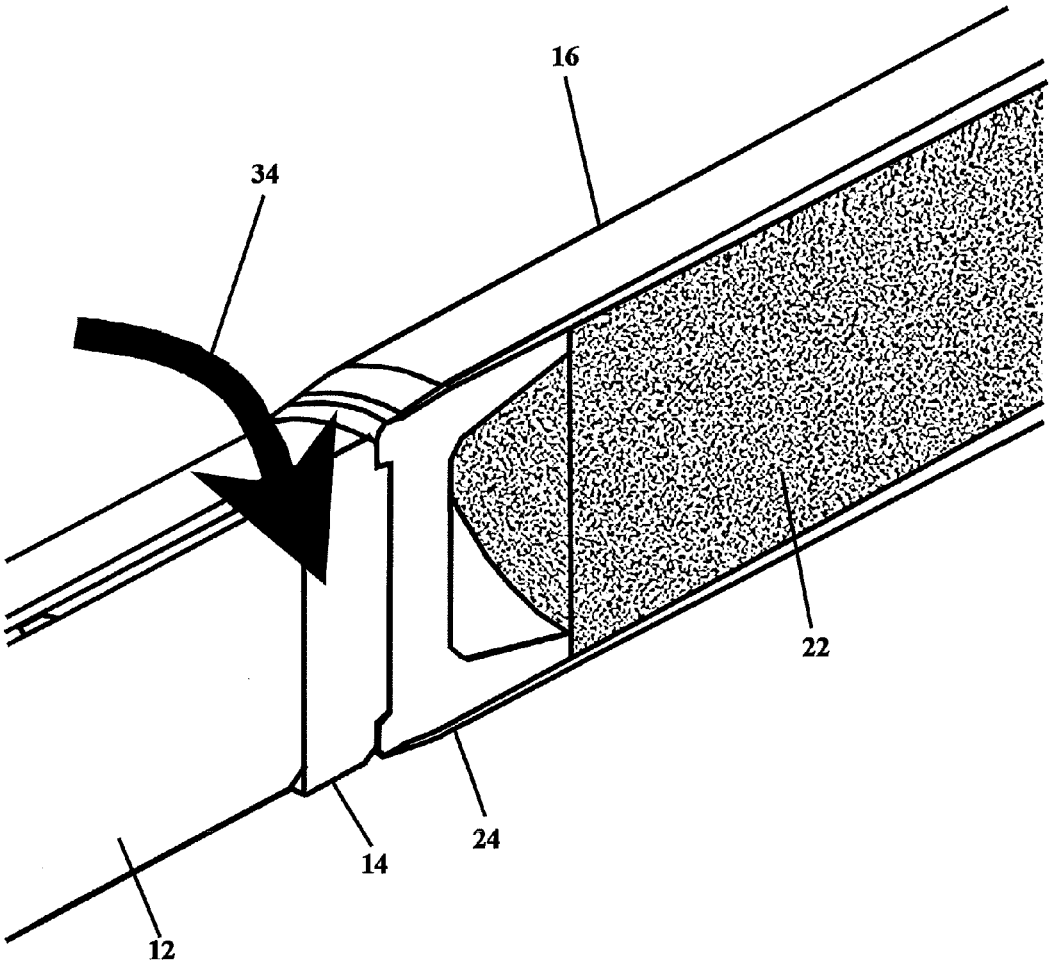
FIG. 5 depicts the mating of the projectile and sabot combination to the casing and cap combination to form the rotational transmission system of FIG. 4.

FIG. 5 depicts the mating of projectile 12 with sabot 14 to casing 16 with cap 24. The indentation 28 on the top surface of cap 24 receives extension 29 on the bottom surface of sabot 14, and these features mate and interlock to ensure concurrent rotation when acted upon by the barrel's rifling. Arrow 34 depicts a rotational direction of spin when the cap/sabot combination is acted upon by the barrel rifling. Other interlocking mechanisms may be used to mechanically communicate the sabot to the cap with performance restrictions, and the present invention is not limited to any one particular interlocking mechanism.

Figure 6A:
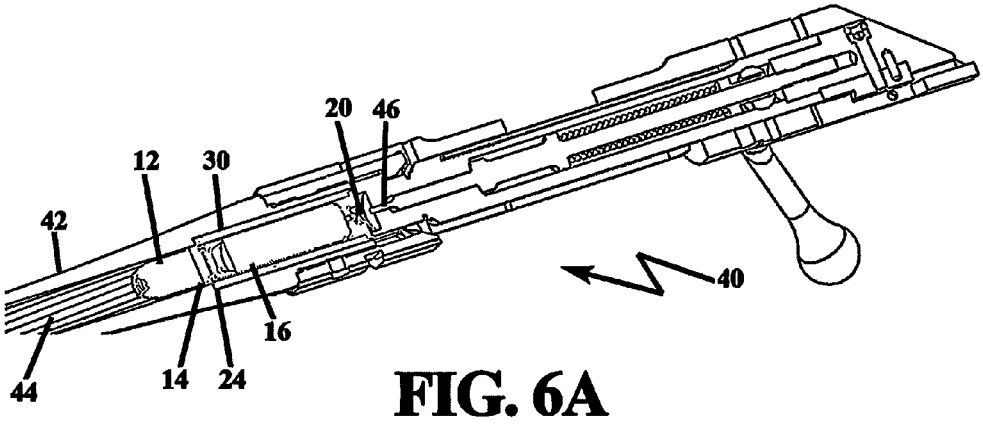
FIG. 6A depicts the ammunition of the present invention in a bolt action rifle.
Figure 6B:
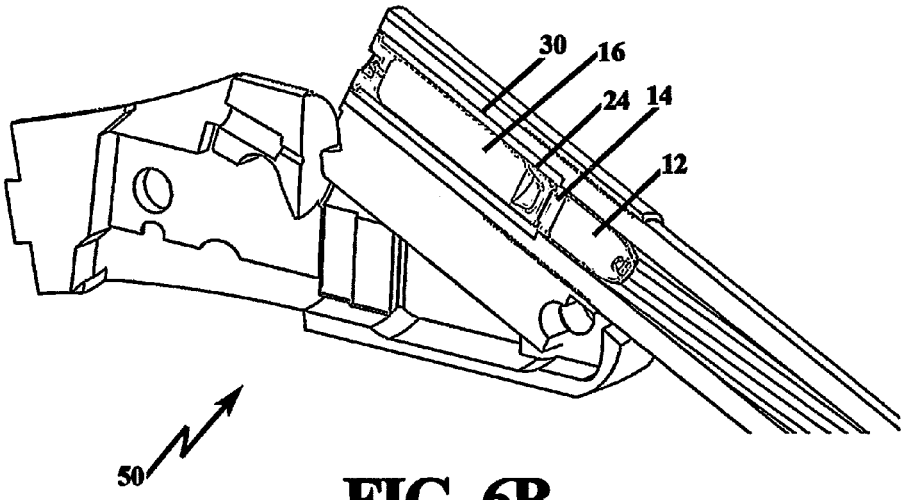
FIG. 6B depicts the ammunition of the present invention in a break open rifle.

FIG. 6A depicts the ammunition of the present invention used in a bolt action rifle 40. Chamber bushing 30 is inserted into the breech end of the barrel. As will be discussed in further detail herein, chamber bushing 30 is a new component of an ammunition system introduced for loading and safety considerations. Projectile 12 is compressed into the barrel from the muzzle end (not shown) and the tight sabot 14 around projectile 12 is in slidable contact with rifling 44 of barrel 42. Primer 20 is aligned to be engaged by firing pin 46 upon firing. In a similar manner, FIG. 6B depicts the ammunition of the present invention as used in a break open rifle 50.

Figure 7:
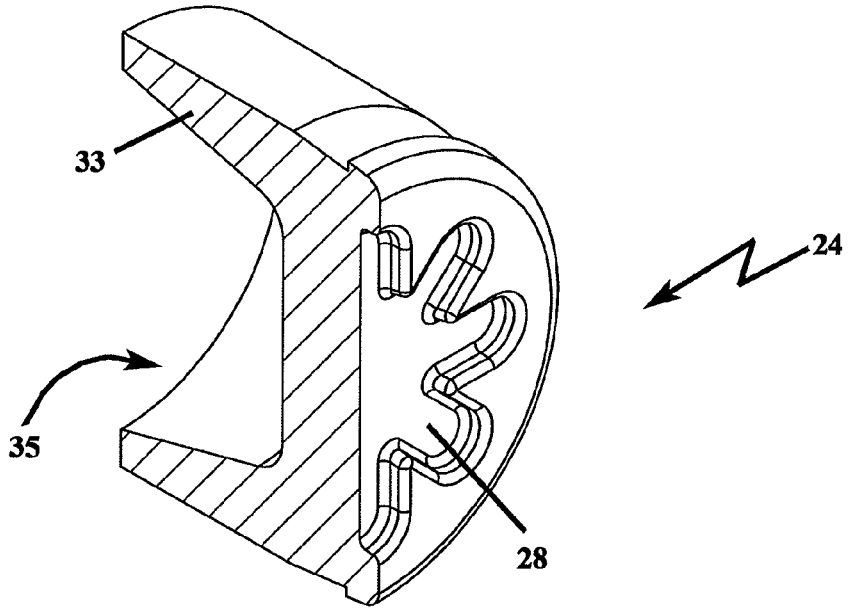
FIG. 7 depicts a perspective cross-sectional view of the top portion of the cap formed for sealing the casing.

FIG. 7 depicts a perspective cross-sectional view of the top portion of cap 24. Preferably, cap 24 includes a plurality of indentations 28, or extensions, or any combination thereof, for mating with a complementary mating bottom portion of sabot 14. Cap 24 includes an extended cylindrical bottom 33 forming a preferred angled cup 35 for capturing gases upon detonation of the propellant charge.

Figure 8:
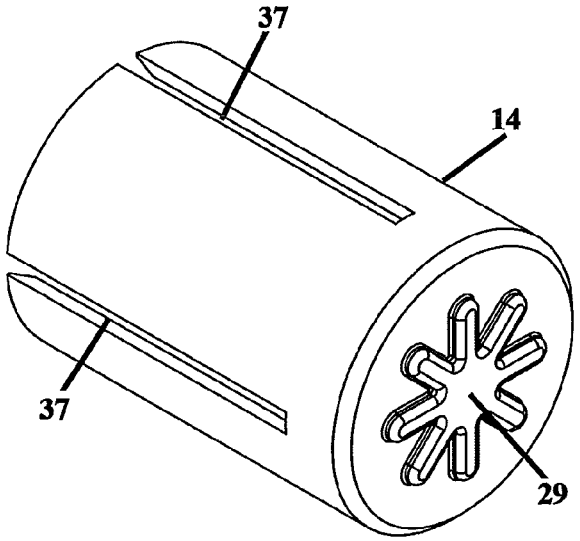
FIG. 8 depicts a perspective view of the bottom portion of the sabot that interlocks with the cap of FIG. 7.

FIG. 8 depicts a perspective view of the bottom portion of sabot 14. In this example, sabot 14 includes a plurality of extensions 29 for complementary mating with indentations 28 of cap 24. A "star" configuration is depicted; however, the present invention is not limited to any particular design, and it is possible for each mating surface of the sabot and cap to have a combination of indentations and extensions that mate in a complementary fashion. As noted in FIG. 8, sabot 14 may further include slots 37 for releasably sliding on the projectile.

Figure 9:
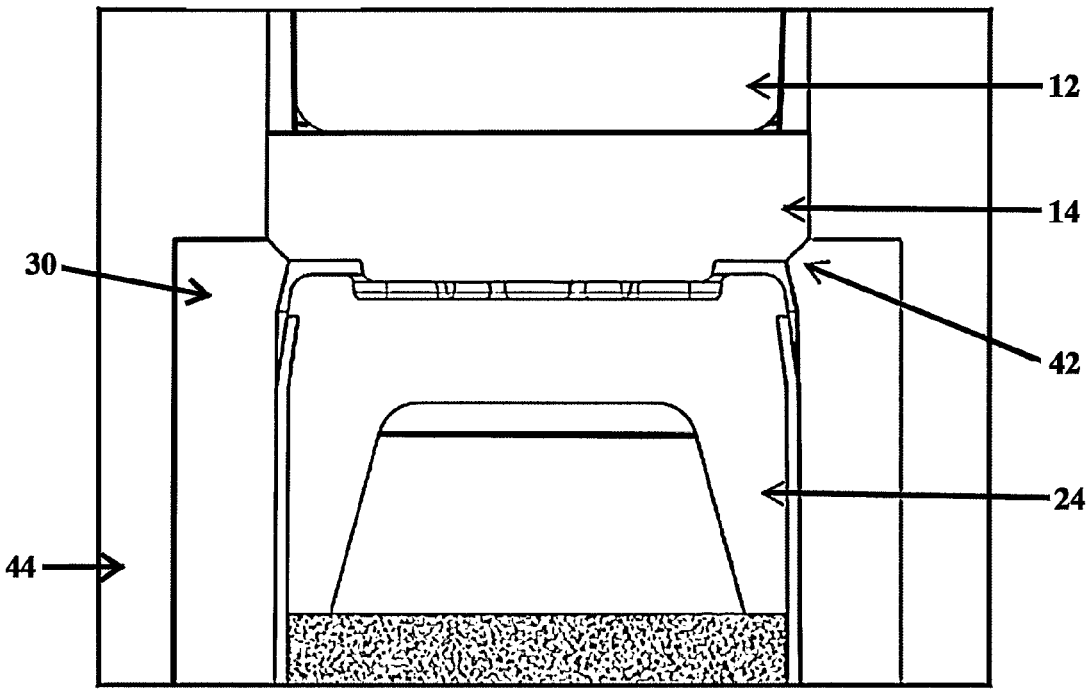
FIG. 9 depicts a cross-sectional view of the mating of the sabot with the cap in the chamber bushing of FIG. 3.

FIG. 9 depicts a cross-sectional view of the mating of sabot 14 with cap 24 in chamber bushing 30. In at least one embodiment, chamber bushing 30 is inserted in the breech end of barrel 44 for the purpose of receiving and securing the casing-cap combination. Chamber bushing 30 is designed to perform the chamber function of the barrel. Tapered projection 42 on chamber bushing 30 ensures that a difference in radius exists between the outside diameter of cap 24 and the innermost diameter of chamber bushing 30 at the tapered projection 42. In this manner, it is impossible to introduce projectile 12 and sabot 14 into the muzzle end of chamber bushing 30.

Figure 10:
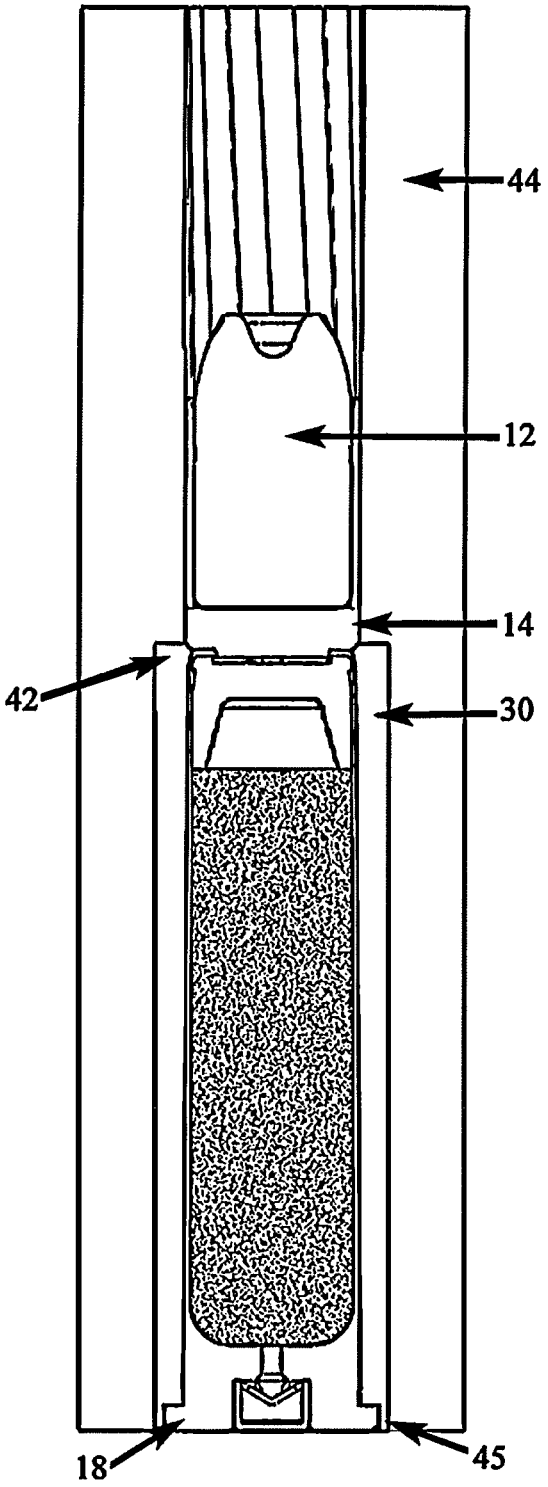
FIG. 10 depicts a cross-sectional view of the mating of the sabot with the cap in the chamber bushing of FIG. 9, also depicting a radial cutout for receiving a rim of the casing at the breech end of the chamber bushing.

Additionally, as shown in FIG. 10, chamber bushing 30 includes a radial cutout 45 for receiving rim 18 of casing 16 at the breech end. By design, the radius of radial cutout 45 is such that it is not possible to introduce the projectile through the same chamber bushing breech end that is measured for the casing.

By virtue of this novel design, it is possible to introduce an ammunition system with a lighter, less expensive ammunition for firearms, including for the preferred use of muzzleloading firearms. The ammunition's casing may be fabricated of recyclable plastic, and may be color coded for distinguishing different types of loads. Advantageously, predetermined amounts of charged propellant may be fabricated and purchased separately. Additionally, different charged propellants, utilizing different powders, can be safely loaded (since they are already measured and secured in the casing) without risk of over-loading or causing subsequent detrimental damage.

For example, smokeless powder, which lends itself to a more critical usage requirement, can be used in a muzzleloading firearm more safely, and with less risk of overloading. Charges, such as nitrocellulose based smokeless powder, are legal propellants in muzzleloaders designed for its use. Other "smokeless powder" charges include Pyrodex™, Triple Se7En™, American Pioneer™, and other synthetic replacements. Pursuant to the present invention, it is possible to load a predetermined amount of smokeless powder into the casing and seal this powder with a cap, such that a user can safely select "smokeless powder" ammunition for use without risk of overcharging the firearm.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. An ammunition for a firearm having a barrel with a breech end and a muzzle end, said ammunition comprising:

a projectile;

a casing having a forward end and a back end, said casing including:

a cap at said forward end for sealing a propellant charge within said casing;

a rim at said back end in mechanical communication with said firearm barrel breech end when said casing is inserted within said barrel;

a primer situated at said casing back end and responsive to a firing pin;

wherein said projectile and said casing are separate components independently loaded into said firearm; and a sabot slidably attached to said projectile;

wherein said cap and said sabot provide seals to trap propellant gases behind said projectile; and wherein said sabot includes a bottom end having at least one indentation or extension, and said cap having a top end adjacent to, and in mechanical communication with, said sabot bottom end when said projectile and said casing are inserted in said barrel, respectively, said cap top end including at least one complementary extension or indentation for insertably receiving said sabot bottom end to interlock with said sabot to ensure concurrent rotation when acting upon by barrel rifling.

2. The ammunition of claim 1 wherein said casing is loaded into said barrel breech end, and said projectile is loaded into said barrel muzzle end.

3. The ammunition of claim 1 wherein said at least one indentation or extension on said sabot bottom end, and said at least one complementary extension or indentation on said cap top end, comprise designed imprints formed in said sabot and said cap respectively.

4. The ammunition of claim 1 wherein said propellant charge includes a predetermined amount of black powder, smokeless powder, or black powder substitutes.

5. The ammunition of claim 1 wherein said cap includes an angled, cup-shaped bottom end facing said propellant charge for capturing gases upon detonation of said propellant charge.

6. A muzzleloading firearm ammunition system including:

a barrel of said muzzleloading firearm having a breech end and a muzzle end, said barrel breech end modified to receive ammunition;

said ammunition comprising a projectile portion and a charge portion, said projectile portion including:

a projectile having a projectile diameter; and a sabot having a sabot diameter, said sabot attached to said projectile;

said charge portion including:

a casing having a top end, a bottom end, and a hollow body, said hollow body containing a predetermined amount of propellant charge;

a cap mounted to said casing top end, said cap having an angled, cup-shaped bottom end facing said propellant charge for capturing gases upon detonation of said propellant charge, and sealing said propellant charge from environmental elements;

said casing bottom end having a rim in mechanical communication with said barrel breech end when said casing is inserted within said barrel breech end, and a primer situated at said casing bottom end and responsive to a firing pin.

7. The ammunition system of claim 6 wherein said barrel breech end includes a chamber bushing having a breech end and a muzzle end and wherein:

said chamber bushing breech end includes an accessible inner diameter for receiving said casing of predetermined outer diameter; and said chamber bushing muzzle end having an inner diameter smaller than said projectile diameter or said sabot diameter, such that loading said projectile from said barrel breech end, or inserting said projectile into said chamber bushing from said chamber bushing muzzle end is physically prohibited.

8. The ammunition system of claim 7 wherein said chamber bushing muzzle end includes a tapered projection having a diameter smaller than a largest diameter of said cap.

9. The ammunition system of claim 6 wherein said sabot includes a bottom end having at least one indentation or extension, and said cap having a top end adjacent said sabot bottom end when said projectile and said casing are inserted in said barrel, respectively, said cap top end including at least one complementary extension or indentation for insertably receiving said sabot bottom end to interlock with said sabot to ensure concurrent rotation when acting upon by barrel rifling.

10. The ammunition system of claim 9 wherein said at least one indentation or extension on said sabot bottom end, and said at least one complementary extension or indentation on said cap top end, comprise a plurality designed imprints formed on said sabot and said cap respectively.

* * * * *